United States Patent [19]

Knoell et al.

[11] Patent Number: 4,968,444

[45] **Date of Patent: * Nov. 6, 1990**

[54] LUBRICATING OIL ADDITIVES

[75] Inventors: Helmut Knoell, Lantertal; Ulrich Schoedel, Rossdorf; Horst Pennewiss, Darmstadt; Heinz Jost, Modautal, all of Fed. Rep. of Germany

[73] Assignee: Röhm GmbH, Darmstadt, Fed. Rep. of Germany

[ * ] Notice: The portion of the term of this patent subsequent to Apr. 18, 2006 has been disclaimed.

[21] Appl. No.: 291,387

[22] Filed: Dec. 27, 1988

Related U.S. Application Data

[63] Continuation of Ser. No. 161,203, Feb. 16, 1988, abandoned, which is a continuation of Ser. No. 68,804, Jun. 29, 1987, abandoned, which is a continuation of Ser. No. 663,067, Oct. 19, 1984, abandoned.

[30] Foreign Application Priority Data

Oct. 28, 1983 [DE] Fed. Rep. of Germany ..... 3339103

[51] Int. Cl.[5] ..... C10M 145/14

[52] U.S. Cl. ..... 252/56 R; 252/51.5 R; 252/56 S; 252/77; 252/79

[58] Field of Search ..... 252/56 R, 77, 79, 51.5 R, 252/56 S

[56] References Cited

U.S. PATENT DOCUMENTS

| | | | |
|---|---|---|---|
| 2,091,627 | 8/1937 | Bruson | 87/9 |
| 2,100,993 | 11/1937 | Bruson | 260/2 |
| 2,114,233 | 4/1938 | Neher et al. | 260/2 |
| 2,655,479 | 10/1953 | Munday et al. | 252/56 |
| 3,513,096 | 5/1970 | Brownawell et al. | 252/59 |
| 4,149,948 | 4/1979 | Wenzel et al. | 252/51.5 |
| 4,282,132 | 8/1981 | Benda et al. | 260/30.2 |
| 4,290,925 | 9/1981 | Pennewiss et al. | 252/56 S |
| 4,822,508 | 4/1989 | Pennewiss et al. | 252/56 R |

FOREIGN PATENT DOCUMENTS

| | | |
|---|---|---|
| 2258966 | 6/1973 | Fed. Rep. of Germany . |
| 1559951 | 1/1980 | United Kingdom . |
| 1559952 | 1/1980 | United Kingdom . |

OTHER PUBLICATIONS

Morawetz, "Macromolecules in Solution", vol. XXI of *High Polymers*, Interscience Publishers, (1965), pp. 85–89.

*Primary Examiner*—Margaret B. Medley

*Attorney, Agent, or Firm*—Curtis, Morris & Safford

[57] ABSTRACT

Additives for n-paraffin-containing lubricating oils, which additives are mixtures of acrylates containing (I) from 10 to 99 weight percent of polymers $P_1$ composed of
- (a) esters of methacrylic acid and/or acrylic acid and linear $C_6$ to $C_{15}$ alcohols;
- (b) esters of methacrylic acid and/or acrylic acid and linear $C_{16}$ to $C_{30}$ alcohols;
- (c) esters of methacrylic acid and/or acrylic acid and branched $C_8$ to $C_{40}$ alcohols;
- (d) esters of methacrylic acid and/or acrylic acid and $C_1$ to $C_5$ alcohols; and
- (e) monomers having functional groups, the amount of (b) being at the most 5 mol percent; and (II) from 90 to 1 weight percent of polymers $P_2$ composed of
- (a') esters of methacrylic acid and/or acrylic acid and linear $C_6$ to $C_{15}$ alcohols;
- (b') esters of methacrylic acid and/or acrylic acid and linear $C_{16}$ to $C_{30}$ alcohols;
- (c') esters of methacrylic acid and/or acrylic acid and branched $C_8$ to $C_{40}$ alcohols;
- (d') esters of methacrylic acid and/or acrylic acid and $C_1$ to $C_5$ alcohols; and
- (e') monomers having functional groups, the amount of (b') being between 10 and 70 mol percent; and a solvent therefor.

14 Claims, No Drawings

LUBRICATING OIL ADDITIVES

This application is a continuation of application No. 07/161,203 filed Feb. 16, 1988 and now abandoned, which in turn is a continuation of application No. 07/068,804 filed June 29, 1987 and now abandoned, which in turn is a continuation of application No. 06/663,067 filed Oct. 19, 1984 and now abandoned.

The present invention relates to multifunctional lubricating oil additives comprising polyalkyl acrylates and polyalkyl methacrylates and to combinations thereof with olefin copolymers or hydrogenated styrene-diene copolymers, for the improvement of the pour point, the viscosity-temperature characteristics at low and high temperatures, and, optionally, the dispersant/detergent properties of lubricating oil.

Lubricating oils usually contain n-paraffin hydrocarbons. While these aid in obtaining good viscosity-temperature characteristics, on cooling they precipitate in crystalline form and thus impede or completely prevent the flowing of the oils. An improvement in the low temperature flow properties can be obtained by deparaffinization. But since the costs rise considerably when the pour point is to be decreased below a certain level, the oils are generally deparaffinized only partly, down to a pour point of about −15° C. The further reduction of the pour point (to about −40° C.) is then effected by means of so-called pour point depressants which effectively lower the pour point even when used in concentrations between 0.05 and 1 percent. It is hypothesized that paraffinlike compounds are incorporated into the growing paraffin crystal surfaces and thus prevent further growth of the crystals and the formation of extensive crystal arrays.

The mode of action of such pour point depressants is based on the fact that they comprise certain structural elements, namely alkyl groups sufficiently long to be incorporated into the growing paraffin crystals right from nucleation and widely spaced side chains or side groups to interfere with crystal growth. (See Ullmanns *Enzyklopaedie der technischen Chemie*, 4th ed., vol. 20, p. 548, Verlag Chemie, 1981.) To be suitable for technical uses, pour point depressants must possess good thermal, oxidative, and chemical stability, shear stability, etc.

The currently preferred pour point depressants are polymethacrylates which lower the pour points of lubricating oils sufficiently even in concentrations between 0.1 and 0.5 percent. (See U.S. Pat. Nos. 2,091,627 2,100,993 and 2,114,233.) The number of carbon atoms in the alkyl groups ranges from 12 to 18 and the degree of branching from 10 to 30 mol percent. Polymethacrylates having molecular weights between about 5,000 and 500,000 are available that permit the flow characteristics of lubricating oils ranging from light, low molecular weight oils to heavy, high molecular weight oils to be improved.

Multifunctional additives for mineral oils should not only lower the pour point but also improve the viscosity-temperature characteristics at both high and low temperatures. This requires larger amounts of additive than would be needed for pour point depressants alone, namely from 1 to 30 weight percent. Such viscosity index (VI) improvers may, moreover, have dispersant/detergent properties. (See Ullmanns *Enzyklopaedie der technischen Chemie*, 4th ed., vol. 20, pp. 457–671.) These multifunctional VI improvers usually comprise polymethacrylate esters (PAMA) and combinations (mixed polymers) of PAMA and olefin copolymers (OCP) or hydrogenated styrenediene (HSD) copolymers, and less frequently OCP or HSD alone.

The present invention has as its object to improve the viscosity-temperature characteristics of mineral oils containing n-paraffins, which characteristics are due to the tendency of n-paraffins to crystallize, in the broadest sense, especially at low temperatures. This object will now be described in greater detail in one of its most acute forms in terms of lubricating oils containing n-paraffins.

As existing oil fields become depleted, less productive or lower grade oil reservoirs are being exploited. Thus supplies of mineral oils (base oils) of lower quality are increasingly encountered. The fact that these oils are deparaffinized to a steadily lesser degree and are more difficult to handle technologically can prove to be critical, which is why they are being referred to as "critical base oils". Thus, there has been a need for pour point or flow improving additives for mineral oils that will facilitate the use even of those mineral oils which are more difficult to handle technologically.

The problems outlined above are compounded by specific application problems. For example, in the case of multigrade motor oils containing OCP's as VI improvers, increased difficulties are encountered with regard to the pour point since OCP's evidently have an adverse effect on the pour point. Difficulties can also arise when OCP-containing lubricating oils are used with diesel engines and diesel fuel gets into OCP-containing motor oils. Despite the dilution which occurs, an increase in pour point due to the diesel fuel is usually observed. The available means have failed to meet fully the new practical requirements.

It has now been found that additives can be adapted to the paraffin content of lubricating oils so that they will permit the problems encountered to be solved if their composition includes, in addition to the usual solvents, mixtures of polymers which contain, as a first component, (I) from 10 to 99 percent by weight of one or more polymers formed from (a) esters of methacrylic acid and/or of acrylic acid and linear alcohols, preferably alkanols, having not fewer than 6 and not more than 15 carbon atoms;

(b) esters of methacrylic acid and/or of acrylic acid and linear alcohols, preferably alkanols, having from 16 to 30 carbon atoms;

(c) esters of methacrylic acid and/or of acrylic acid and of branched alcohols, preferably alkanols, having from 8 to 40 carbon atoms;

(d) esters of methacrylic acid and/or of acrylic acid and alcohols, preferably alkanols, having from 1 to 5 carbon atoms; and (e) monomers capable of free-radical polymerization which carry functional groups in the molecule, the amount of component (a) being between 10 and 100 mol percent, the amount of component (b) being between 0 and 5 mol percent, preferably between 0.5 and 5 mol percent, and more preferably between 1 and 5 mol percent, the amount of component (c) being between 0 and 90/mol percent, and preferably between 0.5 and 90 mol percent, and more preferably between 0.5 and 60 mol percent, the amount of component (d) being between 0 and 50 mol percent, and preferably between 5 and 30 mol percent, and the amount of component (e)

being between 0 and 20 mol percent, and preferably between 2 and 15 mol percent, based in each case on the polymer or polymers in the first component; and, as a second component, (II) from 90 to 1 percent by weight of one or more polymers formed from (a') esters of methacrylic acid and/or of acrylic acid and linear alcohols, preferably alkanols, having not fewer than 6 and not more than 15 carbon atoms;

(b') esters of methacrylic acid and/or of acrylic acid and linear alcohols, preferably alkanols, having from 16 to 30 carbon atoms;

(c') esters of methacrylic acid and/or of acrylic acid and branched alcohols, preferably alkanols, having from 8 to 40 carbon atoms;

(d') esters of methacrylic acid and/or of acrylic acid and alcohols, preferably alkanols, having from 1 to 5 carbon atoms; and (e') monomers capable of free-radical polymerization which have a functional group in the molecule, the amount of component (a') being between 0 and 90 mol percent, and preferably between 30 and 90 mol percent, the amount of component (b') being between 10 and 70 mol percent, the amount of component (c') being between 0 and 90 mol percent, and preferably between 10 and 90 mol percent, and more preferably between 10 and 30 mol percent, the amount of component (d') being between 0 and 50 mol percent, and preferably between 5 and 30 mol percent, and the amount of component (e') being between 0 and 20 mol percent, and preferably between 2 and 15 mol percent, based in each case on the polymer or polymers in the second component, with the sum of (a) to (e) and of (a') to (e') in each case being 100 mol percent.

For the purposes of the present invention, lubricating oils are paraffin base and naphthene base vacuum distillate oils.

It should be noted that the additives of the invention may contain, in addition to a solvent or solvents, VI-improving polyolefins or olefin copolymers (OCP) and/or hydrogenated styrene-diene (HSD) polymers and suitable stabilizers. Hydrogenated styrene-diene polymers of the kind useful in the invention are taught in U.S. Pat. No. 4,282,132, incorporated herein by reference. When the additives of the invention contain olefin copolymers, the resulting systems preferably are like those described and claimed in U.S. 4,290,925, incorporated herein by reference. Namely, the polymer components (I) and (II) comprise a dispersing phase of acrylic acid and/or methacrylic acid esters, the olefin copolymers (which have a molecular weight complementary with respect to the thickening effect desired)are the dispersed phase, and the solvent of the present invention is a vehicle which is a good solvent for said esters but a less good solvent for the olefins because of the esters dissolved therein. As in the referenced patent, preferred stabilizers in such systems are graft or block copolymers A-Y having an olefinic portion, A, and an acrylate ester portion, Y, conforming with the dispersing ester polymer phase (I) and (II).

The olefin copolymers and hydrogenated styrene-diene polymers or the polymers according to the cited U.S. No. 42 82,132 German patent No. 29 05 954 or to U.S. Pat. No. 4,290,925 may make up from 0 to 70 weight percent of the additives.

The solvent is preferably from 20 to 90 percent by weight of the additive. That is polymers (I) and (II) and the olefins or styrene-diene polymers, if present, account for 10 to 80 weight percent of the additives of the invention, and the total polymer content of the additives is preferably from 20 to 80 weight percent.

The amount of the polymer component (I) represented by component (a) preferably ranges from 50 to 100 mol percent and more preferably is 100 mol percent. Component (b') preferably accounts for 20 to 40 mol percent of polymer component (II).

In a preferred embodiment, polymer component (II) is composed solely of components (a') and (b'). With regard to components (a) and (a'), esters of acrylic and/or methacrylic acid and linear $C_{10}$ to $C_{14}$ alcohols are preferred. These may be prepared by the Ziegler process by hydrolysis of aluminum alkoxides. Illustrative of these are the commercially available products "LOROLE" (Henkel KG, Dusseldorf), and "ALFOLE" (Condea, Hamburg).

Components (b) and (b') are preferably esters of acrylic acid and/or of methacrylic acid and linear $C_{16}$ to $C_{24}$ alcohols, and more particularly of $C_{18}$ to $C_{22}$ alcohols. Examples are tallow fatty acids and the "ALFOLE" products mentioned above.

Components (c) and (c') are preferably esters of acrylic and/or methacrylic acid and branched $C_8$ to $C_{20}$ alcohols of the isoalkanol type, and particularly isodecyl, isotridecyl, and isooctadecyl alcohols.

Moreover, components (a), (b), and (c), and (a') (b'), and (c'), may be grafted onto polyolefins or olefin copolymers of the type (OCP) mentioned earlier.

The molecular weights of the polymers in components (I) and (II) generally range from 50,000 to 500,000 as determined by gel permeation chromatography These polymers can be produced by conventional free-radical polymerization methods.

By definition, component (e) of polymer component (I) is formed of monomers capable of free-radical polymerization and having at least one functional group in the molecule, and more particularly monomers of this type which are known for their dispersant and detergent activity in oil additives. Illustrative of these are compounds of the general formula $$H_2C{=}C(R_1)Bs$$

wherein $R_1$ is hydrogen or methyl and Bs is an inert heterocyclic five- or six-membered ring or a $$-\overset{\overset{\displaystyle O}{\|}}{C}-Z-Q-NR_2R_3$$

group, wherein Z is oxygen or a $-NR_4$ group and Q is an optionally alkylated hydrocarbon bridge having from 2 to 10 carbon atoms; $R_2$ and $R_3$ each are alkyl having from 1 to 6 carbon atoms or, taken together with the nitrogen atom (and optionally of other hetero atoms), form a heterocyclic five-or six-membered ring; and $R_4$ is hydrogen or alkyl having from 1 to 6 carbon atoms.

Illustrative of such compounds are C- and N-vinyl pyridine, vinylpyrrolidone, vinylcarbazole, and vinylimidazole and their derivatives, and particularly the N-vinyl compounds, as well as the dialkylaminoalkyl esters of acrylic and methacrylic acid, and particularly dimethylaminoethyl acrylate and methacrylate and dimethylaminopropyl acrylate and methacrylate as well as the corresponding amides, e.g. dialkylaminoalkyl acrylamide or methacrylamide and dimethylaminopropyl acrylamide or methacrylamide.

The above definitions also apply to component (e') of polymer component (II).

Suitable for use as solvents in the additives of the invention are those known in the art for use as lubricating oil additives, and particularly paraffin-based or naphthene-based mineral oils or the known ester oils or poly-alpha-olefins. (See Ullmanns) *Enzyklopaedie der technischen Chemie*, 4th ed., vol. 20, pp. 483–529.)

Polymer components (I) and (II) can be produced by prior art methods.

A mixture of mineral oil and of a monomer mixture composed of (a), (b), (c), (d), and (e) is initially charged into reaction vessel equipped with stirrer, thermometer, reflux condenser, and metering line.

This charge is heated with stirring to about 90° C. to 100° C. under a carbon dioxide atmosphere. After that temperature has been reached and an initiator (preferably peroxy compounds such as peresters, peroxides, or azo compounds) has been added, a mixture of the monomers (a), (b), (c), (d), and (e) and of further initiator is metered in. About two hours after completion of this addition more initiator is fed in. The total amount of initiator usually ranges from 1 to 3 percent by total weight of the monomers. The total polymerization time generally is 8 to 9 hours. A viscous solution with a polymer content that usually ranges from 40 to 70 weight percent is obtained.

To prepare polymer mixtures from components (I) and (II) the following procedure may be employed:

One component is charged to a suitable vessel and heated with stirring to about 80° C. to 120° C. The components to be mixed with it are also heated to 80° C. to 120° C. and added to the previously charged component at as fast a rate as possible, with stirring.

To prepare an oil mixture for measurement of pour point, low- temperature viscosity, and stable pour point, the additive of the invention, optionally together with further additives such as a detergent-inhibitor package and OCP VI improvers, is dissolved with stirring in the base oil at 50° C. to 60° C.

The additives of the invention may be added conventionally to lubricating oils. For motor lubricating oils and automatic transmission fluid oils, the addition of 1 to 10 percent, and preferably from 2 to 6 percent, by weight is recommended, and for hydraulic and gear oils, the addition of from 5 to 30 percent, and preferably from 10 to 20 percent, by weight.

Among the advantages of the invention are pronounced adaptability to any particular base oil, especially to critical base oils and when OCP's are also used. Oil formulations containing the additives in accordance with the invention, in addition to the required viscosities at 100° C., exhibit very good pour point and stable pour point values as well as excellent viscosities at temperatures ranging from −15° C. to 40° C.

They may be characterized by measurements made in conformity with the following standards:

| | |
|---|---|
| Pour point/cloud point | DIN 51497 |
| Pour stability (stable pour point) Std. No. 791/Cycle C | Fed. Test. Meth. 203 |
| MRV viscosity | ASTM D 3829 |
| CCS viscosity | DIN 51377 |
| Brookfield viscosity | DIN 51398 |

A better understanding of the invention and of its many advantages will be had by referring to the following specific examples, given by way of illustration. Certain procedures described below are common to all of the examples.

PRODUCTION OF OIL ADDITIVES

Additive A

The following mixture is charged to a 1-liter four necked flask equipped with stirrer, thermometer, reflux condenser, and metering line:

252 g of mineral oil ($\eta_{100°\,C.}$ = 5.3 mm²/sec), 26.6 g of esters of methacrylic acid and an n-$C_{12}$-$C_{14}$ alcohol mixture, 1.4 g of methyl methacrylate, and 1.6 g of tert-butyl peroctoate.

After the components have dissolved, the following mixture is metered in at 90° C. over a period of 210 minutes at a uniform rate:

304 g of esters of methacrylic acid and an n-$C_{12}$–$C_{14}$ alcohol mixture, 16 g of methyl methacrylate, and 2.56 g of tert-butyl peroctoate.

Two hours after completion of this addition, 0,7 g of tert-butyl peroctoate is fed in. Total polymerization time: 8 hours. A clear viscous solution is obtained.

Polymer content: 58 wt. %.

Viscosity (100° C., 58 wt. %): 500 mm²/sec.

Viscosity (100° C., 5.8 wt. %) in mineral oil of $\eta_{100°\,C.}$ = 5.3 mm²/sec): 11.0 mm²/sec. SSI (5.8 wt. % in mineral oil of $\eta_{100°\,C.}$ = 5.3 mm²/sec): 7.5.

(SSI = Shear Stability Index, i.e. loss in thickening action in percent in the shear stability test in conformity with DIN 51382.)

Additive B

Same procedure as with Additive A, except: Initial charge:

252 g of mineral oil ($\eta_{100°\,C.}$ = 5.3 mm²/sec), 6.2 g of ester of methacrylic acid and an n-$C_{16}$–$C_{18}$ alcohol mixture, 20.4 g of ester of methacrylic acid and an n-$C_{12}$–$C_{14}$ alcohol mixture, 1.4 g of methyl methacrylate, and 1.6 g of tert-butyl peroctoate.

Addition:

71 g of esters of methacrylic acid and an -$C_{16}$–$C_{18}$ alcohol mixture, 233 g of esters of methacrylic acid and an n-$C_{12}$–$C_{14}$ alcohol mixture, 16 g of methyl methacrylate, and 2.56 g of tert-butyl peroctoate.

Additive C

Same procedure as with Additive A, except: Initial charge:

252 g of mineral oil ($\eta_{100°\,C.}$ = 5.3 mm²/sec 6.75 g of esters of methacrylic acid and an n-$C_{18}$–$C_{22}$ alcohol mixture, 19.85 g of esters of methacrylic acid and an n-$C_{12}$–$C_{14}$ alcohol mixture, 1.4 g of methyl methacrylate, and 1.6 g of tert-butyl peroctoate.

Addition:
77.2 g of esters of methacrylic acid and an n-$C_{18}$–$C_{22}$ alcohol mixture,
226.8 g of esters of methacrylic acid and an n-$C_{12}$–$C_{14}$ alcohol mixture,
16 g of methyl methacrylate, and
2.56 g of tert-butyl peroctoate.

Additive D

Same procedure as with Additive A, except: Initial charge:
252 g of mineral oil, ($\eta_{100°\ C.}$ =5.3 mm²/sec)
26.6 g of esters of methacrylic acid and an iso-$C_{10}$ alcohol,
1.4 g of methyl methacrylate, and
1.6 g of tert-butyl peroctoate.
Addition:
304 g of esters of methacrylic acid and an iso-$C_{10}$ alcohol,
16 g of methyl methacrylate, and
2.56 g of tert-butyl peroctoate.
A clear viscous solution is obtained.
Polymer content: 58 wt. %.
Viscosity (100° C., 58 wt. %): 1000 mm²/sec.
Viscosity (100° C., 5.8 wt. % in mineral oil of $\eta_{100°\ C.}$=5.3 mm²/sec
SSI (58 wt. % in mineral oil of $\eta_{100°\ C.}$=5.3 mm²/sec): 7.5.

Additive E

Same procedure as with Additive A, except: Initial charge:
252 g of mineral oil ($\eta_{100°\ C.}$=5.3 mm²/sec),
11.76 g of esters of methacrylic acid and an n-$C_{12}$–$C_{14}$ alcohol mixture,
14.84 g of esters of methacrylic acid and an iso-$C_{18}$ alcohol,
1.4 g of methyl methacrylate, and
1.6 g of tert-butyl peroctoate
Addition:
134.4 g of esters of methacrylic acid and an n-$C_{12}$–$C_{14}$ alcohol mixture and
169.6 g of esters of methacrylic acid and an iso-$C_{18}$ alcohol,
16.0 g of methyl methacrylate, and
2.56 g of tert-butyl peroctoate.

Additive F

Same equipment as with Additive A.
Initial charge:
252 g of mineral oil ( $\eta_{100°\ C.}$ −5.3 mm²/sec),
26.6 g of esters of methacrylic acid and an n-$C_{12}$-$C_{14}$ alcohol mixture,
1.4 g of methyl methacrylate, and
1.6 g of tert-butyl peroctoate.
Addition 1:
152.9 g of esters of methacrylic acid and an n-$C_{12}$–$C_{14}$ alcohol mixture,
8.1 g of methyl methacrylate, and
1.29 g of tert-butyl peroctoate.
This addition is metered in over a period of 210 minutes at a uniform rate. 120 minutes after its completion, addition 2 is started.
Addition 2:
151.1 g of esters of methacrylic acid and an iso-$C_{10}$ alcohol,
7.9 g of methyl methacrylate, and
1.27 g of tert-butyl peroctoate.
Two hours after completion of addition 2, 0.7 g tert-butyl peroctoate is fed in. Total polymerization time: 12 hours. A slightly clouded viscous solution is obtained.
Polymer content: 58 wt. %.
Viscosity (100° C., 5.8 wt. % in mineral oil of $\eta_{100°\ C.}$=5.3 mm²/sec): 11.0 mm²/sec.
SSI (5.8 wt. % in mineral oil of $\eta_{100°\ C.}$ =5.3 mm²/sec): 7.5.

Additive G

To a 1-liter four necked flask equipped with stirrer, thermometer, reflux condenser, and metering line there are charged:
17.4 g of a copolymer of 70 wt. % ethylene and 30 wt. % propylene, molecular weight 80,000 and
252 g of mineral oil ($\eta_{100°\ C.}$=5.3 mm²/sec),
After the copolymer has dissolved within 10 hours at 90° C., the following mixture is added: 28.4 g of esters of methacrylic acid and of an n-$C_{12}$–$C_{14}$ alcohol mixture,
1.5 g of methyl methacrylate, and
1.0 g of tert-butyl peroctoate.
After the components charged have dissolved, the following mixture is metered in at 90° C. over a period of 210 minutes at a uniform rate:
285.7 g of esters of methacrylic acid and an n-$C_{12}$–$C_{14}$ alcohol mixture,
15.0 g of methyl methacrylate, and
1.5 g of tert-butyl peroctoate.
Two hours after completion of this addition, 0.66 g of tert-butyl peroctoate is fed in. After a total polymerization time of 8 hours,
7.8 g mineral oil ($\eta_{100°\ C.}$=5.3 mm²/sec) and
10.76 g N-vinyl-2 pyrrolidone are added to the polymer and the temperature is raised to 130° C. Then 0.9 g tert-butyl perbenzoate is added. After 1 and 2 hours, respectively, a
0.4 g portion of tert-butyl perbenzoate is fed. The charge is maintained at 130° C. for another 5 hours. A clouded viscous solution is obtained.
Polymer content: 58 wt. %.
Viscosity (100° C., 58 wt. %): 2000 mm²/sec.
Viscosity (100° C., 5.8 wt. % in mineral oil of $\eta_{100°\ C.}$=5.3 mm²/sec): 17.0 mm²/sec.
SSI (5.8 wt. % in mineral oil of $\eta_{100°\ C.}$ =5.3 mm²/sec): 32.

Additive H

To a 1-liter four necked flask equipped with stirrer, thermometer, reflux condenser, and metering line there are charged:
258 g of mineral oil ($\eta_{100°\ C.}$=5.3 mm²/sec),
25.8 g of esters of methacrylic acid and a $C_{12}$–$C_{18}$ alcohol mixture with 20% iso components,
2.9 g of methyl methacrylate, and
1.2 g of tert-butyl peroctoate.
After the components have dissolved, the following mixture is metered in at 90° C. over a period of 210 minutes at a uniform rate:
282 g of esters of methacrylic acid and a C-$_{12}$–$C_{18}$ alcohol mixture with 20% iso components,
31.3 g of methyl methacrylate, and
1.9 g of tert-butyl peroctoate.
Two hours after completion of this addition, 0.7 g of tert-butyl peroctoate is fed in and stirring is continued for another 5 hours at 90° C. Then
7.97 g of mineral oil ($\eta_{100°\ C.}$=5.3 mm²/sec) and
10.57 g of N-vinyl-2-pyrrolidone are added and the temperature is raised to 130° C. Then 0.9 g of tert-butyl peroctoate is added. After 1 hour and 2 hours, respectively, a 0.4 g portion of tert-butyl perbenzoate is fed in and this is followed by further stirring for 5 hours at 130° C.

A clear viscous solution is obtained.

Polymer content: 57 wt. %.

Viscosity (100° C., 57 wt. %): 1300 $mm^2$/sec.

Viscosity (100° C., 5.7 wt. % in mineral oil of $\eta_{100° C.}$=5.3 $mm^2$/sec): 14.4 $mm^2$/sec SSI (5.7 wt. % in mineral oil of $\eta_{100° C.}$=5.3 $mm^2$/sec): 24.

Additive J

Procedure as with Additive A, except: Initial charge:

252 g of mineral oil ($n_{100° C.}$−5.3 $mm^2$/sec), 28 g of esters of methacrylic acid and a $C_{12}$–$C_{18}$ alcohol mixture with 13% iso components, and 1.6 g of tert-butyl peroctoate.

Addition:

350 g of esters of methacrylic acid and a $C_{12}$–$C_{18}$ alcohol mixture with 13% iso components and 2.56 g of tert-butyl peroctoate.

Additive K

Procedure as with Additive A, except: Initial charge:

252 g of mineral oil ($\eta_{100° C.}$ =5.3 $mm^2$/sec), 11.7 g of esters of methacrylic acid and an n-$C_{16}$–$C_{18}$ alcohol mixture, 14.9 g of esters of methacrylic acid and an iso-$C_{10}$ alcohol, 1.4 g of methyl methacrylate, and 1.6 g of tert-butyl peroctoate.

Addition:

133.4 g of esters of methacrylic acid and an n-$C_{16}$–$C_{18}$ alcohol mixture, 170.6 g of esters of methacrylic acid and an iso-$C_{10}$ alcohol, 16.0 g of methyl methacrylate, and 2.56 g of tert-butyl peroctoate.

Additive L

To a 1-liter four necked flask equipped with stirrer, thermometer, reflux condenser, and metering line there are charged:

17.4 g of a copolymer of 70 wt. % ethylene and 30 wt. propylene (molecular weight 80,000) and 252 g of mineral oil ($\eta_{100° C.}$ =5.3 $mm^2$/sec), After the copolymer has dissolved within 10 hours at 90° C., the following mixture is added:

11.4 g of esters of methacrylic acid and an n-$C_{16}$–$C_{18}$ alcohol mixture, 6.7 g of esters of methacrylic acid and an n-$C_{12}$–$C_{14}$ alcohol mixture, 10.7 g of esters of methacrylic acid and an iso-$C_{13}$ alcohol, 1.5 g of methyl methacrylate, and 1.7 g of tert-butyl peroctoate.

After the components charged have dissolved, the following mixture is metered in at 90° C. over a period of 210 minutes at a uniform rate: 113.4 g of esters of methacrylic acid and an n-$C_{16}$–$C_{18}$ alcohol mixture, 66.2 g of esters of methacrylic acid and an n-$C_{12}$–$C_{14}$ alcohol mixture 106.1 g of esters of methacrylic acid and iso-$C_{13}$ alcohol, 15.0 g of methyl methacrylate, and 2.7 g of tert-butyl peroctoate.

Two hours after completion of this addition, 0.66 g of tert-butyl peroctoate is fed in. After a total polymerization time of 8 hours, there are added to the polymer: 7.8 g of mineral oil ($\eta_{100° C.}$ =5.3 $mm^2$/sec) and 10.76 g of N-vinyl-2-pyrrolidone and the temperature is raised to 130° C. Then 0.9 g of tert-butyl perbenzoate is added. After 1 and 2 hours, respectively, a 0.4 g portion of tert-butyl perbenzoate is fed in. The charge is maintained at 130° C. for another 5 hours. A clouded viscous solution is obtained.

Polymer content: 58 wt. %.

Viscosity (100° C., 58 wt. %): 1000 $mm^2$/sec.

Viscosity (100° C., 5.8 wt. % in mineral oil of $\eta_{100° C.}$ =5.3 $mm^2$/sec): 14.3 $mm^2$/sec.

SSI (5.8 wt. % in mineral oil of $\eta_{100° C.}$=5.3 $mm^2$/sec): 22.

TABLE 1

| Comparative Examples | | | |
|---|---|---|---|
| | | Pour point in conformity with DIN 54497 with 3% additive | |
| Comparative example No. | Additive or additive mixture | Base oil NS 150[1] (°C.) | Base oil NS 480[2] (°C.) |
| 1 | A | −31 | −5 |
| 2 | B | −34 | −24 |
| 3 | C | −31 | −26 |
| 4 | D | −11 | −5 |
| 5 | E | −10 | −6 |
| 6 | F | −10 | −5 |
| 7 | G | −22 | −8 |
| 8 | H | −35 | −25 |
| 9 | J | −26 | −25 |
| 10 | K | −33 | −25 |
| 11 | L | −36 | −28 |
| 12 | H/J = 3 | −35 | −32 |
| 13 | H/J = 1 | −33 | −30 |
| 14 | D/B = 11.5 | −32 | −19 |
| | = 4.9 | −36 | −21 |
| | = 2.0 | −37 | −25 |
| 15 | D/C = 11.5 | −32 | −20 |
| | = 4.9 | −34 | −23 |
| | = 2.0 | −35 | −26 |
| 16 | D/H = 11/5 | −32 | −16 |
| | = 4.9 | −36 | −22 |
| | = 2.0 | −38 | −25 |

[1]Pour Point = −11° C.
[2]Pour Point = −5° C.

TABLE 2

| Comparative Examples | | | |
|---|---|---|---|
| | | Pour point in conformity with DIN 54497 with 3% additive | |
| Example | Additive mixture | Base oil NS 150[1] (°C.) | Base oil NS 480[2] (°C.) |
| 1 | A/B = 11.5 | −42 | −21 |
| | = 4.9 | −42 | −30 |
| | = 3.0 | −42 | −30 |
| | = 2.0 | −42 | −30 |
| | = 1.0 | −41 | −27 |
| 2 | A/C = 11.5 | −41 | −31 |
| | = 4.9 | −42 | −31 |
| | = 3.0 | −42 | −31 |
| | = 2.0 | −42 | −31 |
| | = 1.0 | −40 | −31 |
| 3 | F/C = 32.3 | −30 | −19 |
| | = 11.5 | −35 | −23 |
| | = 4.9 | −35 | −25 |
| | = 3.0 | −36 | −28 |
| | = 2.0 | −36 | −28 |
| | = 1.0 | −36 | −30 |
| 4 | F/B = 32.3 | −31 | −14 |
| | = 11.5 | −36 | −18 |
| | = 4.9 | −41 | −24 |
| | = 2.0 | −43 | −27 |
| 5 | E/C = 32.3 | −27 | −17 |
| | = 11.5 | −31 | −23 |
| | = 4.9 | −34 | −26 |
| | = 3.0 | −34 | −26 |
| | = 2.0 | −34 | −27 |

TABLE 2-continued

| Example | Additive mixture | Comparative Examples: Pour point in conformity with DIN 54497 with 3% additive: Base oil NS 150[1] (°C.) | Base oil NS 480[2] (°C.) |
|---|---|---|---|
| | = 1.0 | −34 | −27 |
| 6 | G/C = 57.8 | −40 | −9 |
| | = 32.3 | −41 | −19 |
| | = 11.5 | −43 | −32 |
| | = 4.9 | −43 | −33 |
| 7 | G/B = 57.8 | −37 | −6 |
| | = 32.3 | −40 | −7 |
| | = 11.5 | −43 | −13 |
| | = 4.9 | −43 | −19 |

[1]Pour Point = −11° C.
[2]Pour Point = −5° C.

These examples show that the mixtures in accordance with the invention (Examples 1 to 7) yield better pour point values in both base oils tested than do the prior art additives or additive mixtures (Comparative Examples 1 to 16).

What is claimed is:

1. An additive for a lubricating oil containing an n-paraffin, said additive comprising from 20 to 90 percent by weight of a solvent, the balance being a mixture comprising 10–99 percent, by weight of said mixture, of a first polymer component (I) which is at least binary, and from 90–1 percent, by weight of said mixture, of a second polymer component (II), said first polymer component comprising:

(I) (a) 10–98 mol percent of an ester formed between at least one member selected from the group consisting of methacrylic acid and acrylic acid and a linear alcohol having 6–15 carbon atoms;

(I)(b) 0–5 mol percent of an ester formed between at least one member selected from the group consisting of methacrylic acid and acrylic acid and a linear alcohol having 16–30 carbon atoms;

(I)(c) 0–90 mol percent of an ester formed between at least one member selected from the group consisting of methacrylic acid and acrylic acid and a branched alcohol having 8–40 carbon atoms;

(I)(d) 0–50 mol percent therein of an ester formed between at least one member selected from the group consisting of methacrylic acid and acrylic acid and an alcohol having 1–5 carbon atoms; and (I)(e) 2–20 mol percent of a monomer capable of free radical polymerization, different from monomers (I)(a)–(I)(d), and having at least one functional group in the molecule, said monomer being selected from the group consisting of compounds of the formula $$H_2C{=}C(R_1)Bs,$$

wherein $R_1$ is hydrogen or methyl and BS is an inert heterocyclic five- or six- membered ring or is $$-\underset{\underset{O}{\|}}{C}-Z\text{-}Q\text{-}NR_2R_3,$$

wherein Z is oxygen or —$NR_4$—, Q is a hydrocarbon bridge having from 2 to 10 carbon atoms, $R_2$ and $R_3$, taken alone, each are alkyl having from 1 to 6 carbon atoms, or, taken together with the nitrogen atom, form a heterocyclic five- or six- membered ring, and $R_4$ is hydrogen or alkyl having from 1 to 6 carbon atoms;

said second polymer component comprising:

(II)(a') 0–90 mol percent of an ester formed between at least one member selected from the group consisting of methacrylic acid and acrylic acid and a linear alcohol having 6–15 carbon atoms;

(II)(b') 10–70 mol percent of an ester formed between at least one member selected from the group consisting of methacrylic acid and acrylic acid and a linear alcohol having 16–30 carbon atoms;

(II)(c') 0–90 mol percent of an ester formed between at least one member selected from the group consisting of methacrylic acid and acrylic acid and a branched alcohol having 8–40 carbon atoms;

(II)(d') 0–50 mol percent of an ester formed between at least one member selected from the group consisting of methacrylic acid and acrylic acid and an alcohol having 1–5 carbon atoms; and (II)(e') 0–20 mol percent of a monomer capable of free radical polymerization, different from monomers (II)(a')–(II)(d'), and having a functional group in its molecule.

2. An additive as in claim 1 which additionally comprises up to 70 percent, by weight of said additive, of at least one member selected from the group consisting of VI-improving olefin copolymers and hydrogenated styrene-diene copolymers.

3. An additive as in claim 2 wherein said solvent is a good solvent for polymer components (I) and (II), a less good solvent for said olefin copolymers by virtue of the polymer components (I) and (II) dissolved therein, and which additionally comprises a stabilizer which is a block or graft copolymer, A-Y, wherein A comprises olefinic monomers and Y comprises acrylate ester and methacrylate ester monomers.

4. An additive as in claim 2 wherein said mixture including polymer components (I) and (II) and said member is from 20 to 80 percent by weight of said component.

5. An additive as in claim 1 wherein polymer component (I)(a) is at least 50 mol percent of said component.

6. An additive as in claim 1 wherein polymer component (I)(a) is 100 mol percent by said component.

7. An additive as in claim 1 wherein polymer component (II)(b') is 20-40 mol percent by weight of said component.

8. An additive as in claim 1 wherein at least one of polymer components (I)(a) and (II)(a') is an ester formed from a linear alcohol having 10–14 carbon atoms.

9. An additive as in claim 1 wherein at least one of polymer components (I)(b) and (II)(b') is an ester formed from a linear alcohol having 16–24 carbon atoms.

10. An additive as in claim 1 wherein at least one of polymer components (I)(c) and (II)(c') is an ester formed from a branched alcohol having 18–22 carbon atoms 11. An additive as in claim 1 wherein at least one of polymer components (I)(c) and (II)(c') is formed from a branched alcohol having 8–20 carbon atoms.

12. An additive as in claim 1 wherein at least one of polymer components (I)(c) and (II)(c') is formed from at least one branched alcohol selected from the group consisting of iso-$C_{10}$, iso-$C_{13}$, and iso-$C_{18}$ alcohols.

13. An oil, containing an n-paraffin which is a member selected from the group consisting of motor lubricating oils and automatic transmission fluid oils and comprising therein 1–10 percent by weight of an additive as in claim 1.

14. An oil, containing an n-paraffin, which is a member selected from the group consisting of hydraulic oils and gear oils and comprising therein 5–30 percent by weight of an additive as in claim 1.

* * * * *